United States Patent [19]

Ohsawa

[11] Patent Number: 4,722,289

[45] Date of Patent: Feb. 2, 1988

[54] SEWING MACHINE

[75] Inventor: Hirobumi Ohsawa, Kanagawa, Japan

[73] Assignee: Ikeda Bussan Co., Ltd., Ayase, Japan

[21] Appl. No.: 63,432

[22] Filed: Jun. 18, 1987

[30] Foreign Application Priority Data

Aug. 28, 1986 [JP] Japan ..... 61-201994

[51] Int. Cl.[4] ..... D05B 35/06

[52] U.S. Cl. ..... 112/137; 112/152; 112/311; 112/320; 112/DIG. 2

[58] Field of Search ..... 112/137, 138, 141, 147, 112/136, DIG. 2, DIG. 3, 152, 153, 311, 320

[56] References Cited

U.S. PATENT DOCUMENTS 1,489,217 4/1924 Jones ..... 112/138 X
2,452,419 10/1948 Ackerman ..... 112/138
3,204,591 9/1965 Pickett ..... 112/DIG. 2
3,221,685 12/1965 Greenberg ..... 112/138
3,631,826 1/1972 Morgan ..... 112/DIG. 2

*Primary Examiner*—H. Hampton Hunter
*Attorney, Agent, or Firm*—Schwartz, Jeffery, Schwaab, Mack, Blumenthal & Evans

[57] ABSTRACT

Herein disclosed is a material setter for a sewing machine having a hollowed folder through which a tape-like material passes to be folded before it is stitched. The material setter comprises a shoe member frictionally contacting with the material through a slot formed in the folder, a reciprocating device for reciprocatively moving the shoe member along the way of the material in the folder, and a one-way device for causing the shoe member to move the material forward only when the shoe member is moved forward by the reciprocating device.

17 Claims, 8 Drawing Figures

SEWING MACHINE

BACKGROUND OF THE INVENTION

1. Field of the Invention

The present invention relates in general to a sewing machine which stitches cloth, leather and other material by means of an eye-pointed needle, and more particularly, the present invention is concerned with a sewing machine of a type having a folder by which a tapelike material is continuously folded into two before it is stitched by the needle.

2. Description of the Prior Art

In order to clarify the task of the present invention, one conventional sewing machine of the above-mentioned type will be outlined in the following with reference to FIGS. 5, 6 and 7 of the attached drawings.

Referring to the drawings, particularly FIG. 5, there is shown an essential part of the conventional sewing machine 100 which generally comprises an eyepointed reciprocating needle 12, a liftable presser 14 for putting a suitable weight upon a tape-like material 16 and a carrier (not shown) located below the presser 14 for intermittently carrying the material 16 forward, that is, toward the needle 12. The sewing machine 100 is provided with a folder 18 by which the tape-like material 16 is continuously folded into two parts 16*a* and 16*b* before it is stitched by the needle 12. As is seen from FIG. 5, the holder 18 is constructed of a bent-up hollow plate member which comprises an equilateral triangular major portion 18*a* having an elongate inlet slot 20, an inequilateral triangular upper portion 18*b* extending along the upper side of the major portion 18*a* and having an outlet slot 22*a*, and an inequilateral triangular lower portion 18*c* extending along the lower side of the major portion 18*a* and having an outlet slot 22*b*. As may be understood from FIG. 8, the outlet slots 22*a* and 22*b* are joined at their one ends to form a compressed U-shaped outlet which faces toward the needle 12. The major portion 18*a* is formed at its one wall with a longitudinally extending slot 24 which is exposed to the hollow of the major portion 18*a*. During sewing operation of the sewing machine 100, the tape-like material 16 is continuously fed into the folder 18 from the inlet slot 20 and gradually folded into two parts during its passage through the hollow allowing the U-shaped outlet (22*a*, 22*b*) of the holder 18 to continuously draw out a twice-folded material (16*a*, 16*b*) which is to be stitched.

In order to set the tape-like material 16 to the folder 18 for preparation of sewing, a leading end of the material 16 is manually thrusted into the folder 18 to such a degree that a part of the inserted material 16 is exposed to the slot 24 of the major portion 18*a*. Then, a pin-mounted tool 26 (see FIG. 5) is manipulated to stick the pin into the inserted material 16 through the slot 24. Then, the tool 26 is moved forward, that is, toward the U-shaped outlet of the folder 18 with the pin catching the material 16, until the twice-folded leading end (16*a*, 16*b*) of the material 16 projected from the outlet comes to the position of the needle 12. Then, the tool 26 is removed and the sewing machine 100 is operated for continuously stitching the twice-folded parts 16*a* and 16*b* of the material 16 drawn from the folder 18.

However, the manual work for setting the material 16 to the folder 18 is difficult or at least troublesome. In fact, the setting has required a skilled technique.

SUMMARY OF THE INVENTION

It is therefore an object of the present invention to provide a sewing machine which is free of the above-mentioned drawback.

According to the present invention, there is provided, in a sewing machine of the above-mentioned type, a material setter by which the setting of a tape-like material to the folder is readily and quickly achieved.

According to the present invention, there is provided, in a sewing machine including a hollowed folder through which a tape-like material continuously passes to be folded before it is stitched, a material setter which comprises means defining in the folder a slot through which at least a part of the material is exposed to the outside; a shoe member frictionally contacting with the material through the slot; reciprocating means for reciprocatively moving the shoe member along the way of the material; and one-way means for causing the shoe member to move the material forward only when the shoe member is moved forward by the reciprocating means.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
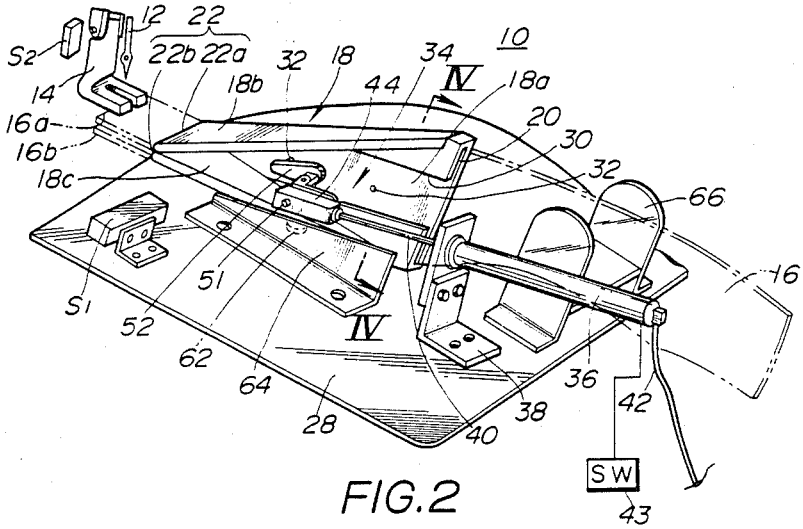
FIG. 1 is a perspective view of a sewing machine according to the present invention.
Figure 2:
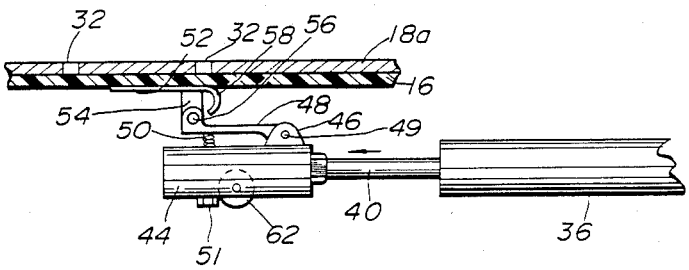
FIG. 2 is a top view of a material setter employed in the sewing machine of the invention.
Figure 5:
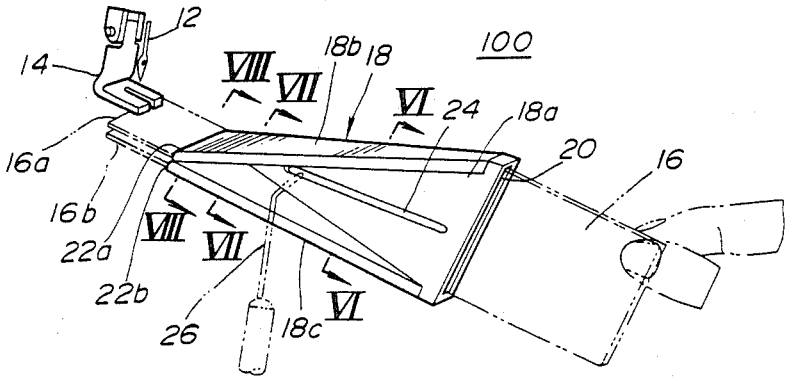
FIG.5 (PRIOR ART)
FIG. 5 is a perspective view of an essential part of a conventional sewing machine.
Figure 6:
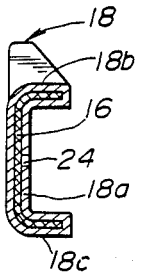
FIG. 6 is a sectional view taken along the line VIII—VIII of FIG. 5.
Figure 7:
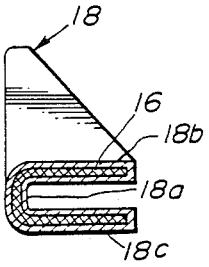
FIG. 7 is a sectional view taken along the line VII—VII of FIG. 5.
Figure 8:
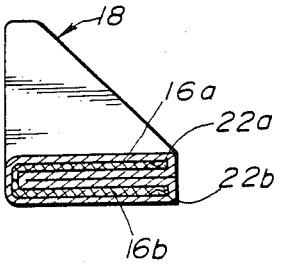
FIG. 8 is a sectional view taken along the line IV—IV of FIG. 5.

Referring to FIGS. 1 to 4, particularly FIG. 1, there is shown a sewing machine 10 according to the present invention, which is free of the drawback encountered in the above-mentioned conventional sewing machine of FIG. 5. In the following, substantially the same parts as those in the afore-mentioned conventional sewing machine 100 are denoted by the same numerals.

The sewing machine 10 of the present invention comprises an eye-pointed reciprocating needle 12, a liftable presser 14 for putting a suitable weight upon a twice-folded parts 16*a* and 16*b* of the tape-like material 16 and a carrier (not shown) located below the presser 14 for intermittently carrying the material 16 forward, that is, toward the position of the needle 12. The sewing machine 10 is provided with a folder 18 by which the tape-like material 16 is continuously folded into two parts 16*a* and 16*b* before it is stitched by the needle 12. Similar to the holder 16 of the afore-mentioned conventional sewing machine 100, the holder 16 in the present invention is constructed of a bent-up hollow plate member which is securely mounted on a base plate 28 and comprises an equilateral major portion 18*a* having an elongate inlet slot 20, an inequilateral upper portion 18*b* extending along the upper side of the major portion 18*a* and having an outlet slot 22*a*, and an inequilateral triangular lower portion 18*c* extending along the lower side of the major portion 18*a* and having an outlet slot 22*b*. The outlet slots 22*a* and 22*b* are joined at their one ends to form a compressed U-shaped outlet 22 which faces toward the position of the needle 12. As shown in the drawing (FIG. 5), the major portion 18*a* of the folder 18 is formed at its one wall with a longitudinally extending wide slot 30 which is merged with the hollow of the major portion 18*a*. For the purpose which will become apparent as the description proceeds, the other wall of the major portion 18*a* is formed with several openings 32 through which compressed air is blown into the hollow of the major portion 18*a*. For this, a suitable number of tubes leading from a source of compressed air are connected to the openings 32 from outside of the folder 18.

According to the present invention, there is provided a material setter 34 which, upon requirement of setting of the tape-like material 16 to the folder, moves the material 16 to the position of the needle 12 through the folder 18.

The material setter 34 comprises an air cylinder unit which includes a cylinder 36 connected to the base plate 28 through a holder 38, and a piston rod 40 reciprocatively engaged with the cylinder 36. The cylinder 36 is connected through a tube 42 to a source (not shown) of compressed air. A known electric valve is housed in the cylinder 36 for reciprocatively moving the piston rod 40 when it assumes its open position. For controlling the electric valve, a manual switch 43 is connected to the same. The air cylinder unit is somewhat inclined relative to the base plate 28 so that the piston rod 40 can move along the axis of the wide slot 30 of the major portion 18*a* of the folder 18. A rectangular parallelepiped block 44 is fixed to the leading end of the piston rod 40 to move together. As is best seen from FIG. 2, the block 44 is formed, at its one side facing the wide slot 30 of the folder 18, with a bracket 46 to which a supporting lever 48 is pivotally connected through a pivot pin 49. A spring 50 is compressed between the lever 48 and the block 44 to bias the lever 48 to pivot toward the wide slot 30 of the folder 18. The biasing force of the spring 50 is adjusted by turning a screw 51 which is held by the block 44 with its leading end engaged with the spring 50. A triangular shoe member 52 is pivotally connected at its base portion 54 to the leading end of the supporting lever 48 through a pivot pin 56. It is to be noted that the pivot pins 49 and 56 extend perpendicular to the axis of the piston rod 40. A coil spring (not shown) is disposed about the pin 56 to bias the shoe member 52 in a clockwise direction in FIG. 1. As is seen from FIG. 2, one end portion 58 of the shoe member 52, that is, the portion directed upstreamly with respect to the flow of the tape-like material 16, is curled backwardly, and as is seen from FIG. 3, the shoe member 52 is equipped, at its one side facing the side slot 30 of the folder 18, with a frictional plate 60, such as, a punched metal plate or the like, for the purspose which will become apparent hereinafter.

As is seen from FIG. 1, the block 44 is provided at its lower side with a roller 62 which rotates about an axis perpendicular to the axis of the piston rod 40 of the cylinder unit. The roller 62, upon reciprocating movement of the piston rod 40, runs on and along a guide rail 64 which extends in parallel with the piston rod 40 and is secured to the base plate 28. Designated by numeral 66 is a guide device which guides the movement of the tape-like material 16 which is to be fed into the folder 18. Desiganted by reference $S_1$ is a first known sensor which senses whether the material 16 is present in the folder 18 or not. With this sensor, running out of the material 16 is detected. Designated by reference $S_2$ is a second known sensor which senses the twice-folded leading end of the material 16 when the same comes to the position of the needle 12 for setting the material 16 to the folder 18 for preparation of sewing. Although not shown in the drawings, a known control system is employed for retracting the piston rod 40 when the second sensor $S_2$ detects the leading end of the material 16.

In operation of the sewing machine 10, the tape-like material 16 is continuously fed into the folder 18 by the work of the material carrier and gradually folded into two before it is stitched by the needle 12, like in the case of the afore-mentioned conventional one. During this operation, compressed air is blown into the hollow 30 of the folder 18 through the openings 32 to form a compressed air space between the material 16 and the inner wall of the folder 18. With this, the friction between the moving material 16 and the inner wall of the folder 18 is reduced thereby smoothing the movement of the material 16 in the folder 18.

Figure 3:
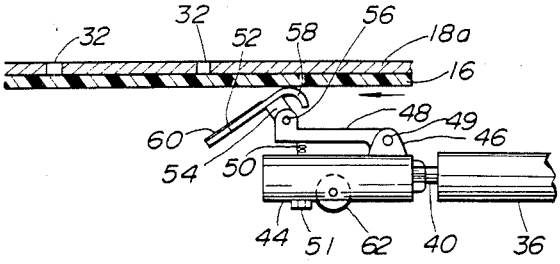
FIG. 3 is a view similar to FIG. 2, but showing other condition of the material setter.
Figure 4:
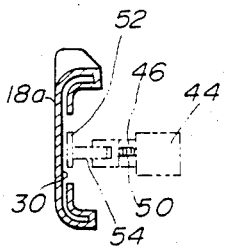
FIG. 4 is a sectional view taken along the line IV—IV of FIG. 1.

However, during this normal or stitching operation of the sewing machine 10, the material setter 34 is at a standstill wherein, as is seen from FIG. 3, the block 44 on the piston rod 40 assumes its home position due to a retracted condition of the piston rod 40 and the shoe member 52 is kept inclined toward the needle 12 due to a frictional force produced between the moving material 16 and the shoe member 52. That is, during the normal operation, the backwardly curled portion 58 of the shoe member 52 serves as a holder for the moving material 16.

In order to set the tape-like material 16 to the folder 18 for preparation of sewing, a leading end of the material 16 is manually thrusted into the folder 18 through the inlet slot 20 to such a degree that the inserted part of the material 16 is engaged with the shoe member 52 with a sufficient contact surface area gained therebetween. At this time, the block 44 on the piston rod 40 assumes the home position. Then, the switch 43 is manipulated to open the electric valve in the cylinder 36. With this, the piston rod 40 starts to reciprocate causing the shoe member 52 to push the inserted material 16 forward but intermittently. That is, due to the pivotal and curled construction of the shoe member 52 as described hereinabove, a forward movement of the shoe member 52 induces a forward movement of the material 16, but a backward movement of the shoe member 52 does not induce a backward movement of the material 16. In fact, a backward stroke of the piston rod 40 is carried out with the shoe member 52 inclined forward producing a negligible friction between the curled portion of the shoe member 52 and the material 16, as may be understood from FIG. 3. Because of provision of the guide rail 64 on and along which the guide roller 62 of the block 44 runs, the reciprocating movement of the shoe member 52 is smoothly achieved. When the folded leading end of the material 16 is pushed out from the folder 34 and comes to the position of needle 12, the second sensor $S_2$ senses completion of setting of the material 16 to the folder 18 and thus stops the reciprocating movement of the piston rod 40 and returns the piston rod 40 to the home position. Then, stitching by the needle 12 follows in a manner as is described hereinabove. Of course, during this material setting, compressed air may be injected into the hollow of the folder 18 in order to smooth the setting.

What is claimed is:

1. In a sewing machine including a hollowed folder through which a tape-like material continuously passes to be folded before it is stitched, a material setter comprising:

means defining in a wall portion of said folder a slot through which at least a part of the tape-like material is exposed to the outside;

a shoe member frictionally contacting with said tape-like material through said slot;

reciprocating means for reciprocatively moving said shoe member along the way of the tape-like material in the folder; and one-way means for causing said shoe member to move said tape-like material forward only when said shoe member is moved forward by said reciprocating means.

2. A material setter as claimed in claim 1, in which said slot of the folder extends along the way of said tape-like material in said folder.

3. A material setter as claimed in claim 1, in which said shoe member is equipped with a friction plate for increasing friction produced between said shoe member and said tape-like material.

4. A material setter as claimed in claim 3, in which said friction pate is a punched metal plate.

5. A material setter as claimed in claim 1, in which said reciprocating means has a reciprocating rod which carries thereon said shoe member through said one-way means.

6. A material setter as claimed in claim 5, in which said reciprocating rod moves respectively in a direction parallel with the longitudinal axis of said slot of the folder.

7. A material setter as claimed in claim 6, in which said one-way means comprises:

a lever having one end pivotally connected through a first pivot pin to said reciprocating rod and the other end pivotally connected through a second pivot pin to said shoe member;

first biasing means for biasing said lever in a direction to press said shoe member against the tape-like material; and second biasing means for biasing said shoe member to pivot in a given direction relative to said lever.

8. A material setter as claimed in claim 7, in which said first and second pivot pins extend perpendicular to the axis of said reciprocating rod.

9. A material setter as claimed in claim 8, in which the other end of said reciprocating rod is equipped with a supporting block to which said lever is pivotally connected through said first pivot pin.

10. A material setter as claimed in claim 9, in which said supporting block is provided with an adjusting screw which adjusts the biasing force of said first biasing means when rotated relative to said supporting block.

11. A material setter as claimed in claim 10, further comprising guide means for smoothly guiding the reciprocating movement of said reciprocating rod.

12. A material setter as claimed in claim 11, in which said guide means comprises:

a roller rotatably connected to said supporting block; and a guide rail extending along the axis of said reciprocating rod and secured to a fixed member, said roller running on and along said guide rail upon the reciprocating movement of said reciprocating rod.

13. A material setter as claimed in claim 12, in which said reciprocating rod is a piston rod of an air cylinder unit.

14. A material setter as claimed in claim 13, further comprising:

an electric valve installed in an air cylinder of said air cylinder unit for, when opened, causing said piston rod to move reciprocatively by force of compressed air; and an electric switch connected to said electric valve to control the same.

15. A material setter as claimed in claim 8, in which said one-way means further comprises a backwardly curled end portion of said shoe member.

16. A material setter as claimed in claim 1, further comprising air injecting means for injecting compressed air into a space between said tape-like material and the other wall of the folder thereby to smooth the movement of said tape-like material in the folder.

17. A material setter as claimed in claim 16, in which said air injecting means comprises:

means defining in the other wall of the folder a plurality of openings which are communicated with said hollow of the folder; and tubes connecting said openings with a source of compressed air.

* * * * *